US007911760B2

(12) United States Patent
Lownds

(10) Patent No.: US 7,911,760 B2
(45) Date of Patent: Mar. 22, 2011

(54) ELECTRONIC BLASTING SYSTEM

(75) Inventor: Charles Michael Lownds, Aurora, CO (US)

(73) Assignee: Orica Explosives Technology Pty Ltd, Melbourne (AU)

( * ) Notice: Subject to any disclaimer, the term of this patent is extended or adjusted under 35 U.S.C. 154(b) by 148 days.

(21) Appl. No.: 11/885,643

(22) PCT Filed: Mar. 9, 2006

(86) PCT No.: PCT/AU2006/000315

§ 371 (c)(1),
(2), (4) Date: Oct. 22, 2007

(87) PCT Pub. No.: WO2006/094358

PCT Pub. Date: Sep. 14, 2006

(65) Prior Publication Data

US 2008/0134923 A1 Jun. 12, 2008

Related U.S. Application Data

(60) Provisional application No. 60/659,407, filed on Mar. 9, 2005.

(51) Int. Cl.
*F23Q 21/00* (2006.01)

(52) U.S. Cl. ..... 361/249

(58) Field of Classification Search ..... 361/248, 361/249

See application file for complete search history.

(56) References Cited

U.S. PATENT DOCUMENTS

| | | | |
|---|---|---|---|
| 4,846,066 | A | 7/1989 | Beattie et al. |
| 5,295,438 | A | 3/1994 | Hill et al. |
| 5,406,890 | A | 4/1995 | Marsh et al. |
| 6,173,651 | B1 | 1/2001 | Pathe et al. |
| 6,789,483 | B1 | 9/2004 | Jennings, III et al. |
| 7,146,912 | B2 | 12/2006 | Hallin et al. |

FOREIGN PATENT DOCUMENTS

| | | | |
|---|---|---|---|
| AU | 2002100859 | A4 | 5/2003 |
| EP | 0 420 673 | A2 | 9/1990 |
| ES | 2 084 663 | T | 5/1996 |
| ES | 2 132 048 | T | 8/1999 |
| WO | WO-00/09967 | A1 | 2/2000 |

*Primary Examiner* — Jared J Fureman
*Assistant Examiner* — Nicholas Ieva
(74) *Attorney, Agent, or Firm* — Birch, Stewart, Kolasch & Birch, LLP

(57) ABSTRACT

An electronic blasting system (1) comprising a control unit (3), a surface harness and electronic detonators (4) connected to the surface harness by a 2-wire lead, the detonators (4) being adapted to provide information to the control unit (3) in response to command signals transmitted by the control unit (3) along the surface harness; wherein the surface harness comprises a primary line (2) with trunk lines (5) connect to it, wherein each trunk line (5) has connected to it individual detonators (4) making up the same row, wherein each trunk line (5) is connected to the primary line (2) by an actuator (6), and wherein each trunk line (5) includes an actuator (7) between adjacent detonators (4).

19 Claims, 6 Drawing Sheets

ELECTRONIC BLASTING SYSTEM

BACKGROUND OF THE INVENTION

The present invention relates to an electronic blasting system for use in mining operations and the like, and to a method of blasting using the system.

Pyrotechnic initiation systems for actuating multi-hole blasts are well known. With such systems each hole-to-hole connection carries with it a particular surface delay. By suitable selection of delay times and connection order of in-hole initiators (detonators), a blast designer can achieve a wide range of firing patterns. This approach is sometimes referred to as "delay-by-hook up". The lead-in line for a blast enters the network of blastholes at the first hole to be fired with connections leading away from this hole delaying each subsequent hole relative to the preceding neighbour. Whilst useful, pyrotechnic blasting systems do however have some fundamental limitations. The main limitations are that pyrotechnic blasting systems provide only a limited range of available delay times and that they suffer from relatively poor accuracy and precision.

In contrast, there now exist electronic detonators that are freely programmable with respect to detonation delay and that are also very accurate with respect to that delay. Electronic detonators are therefore extremely useful in multi-hole blasting operations where individual blastholes are required to detonate (fire) in a predetermined and precise time sequence. The timing sequence is of course known in advance and is programmed into individual detonators based on the position of the detonator in the overall sequence of blasting.

Broadly speaking, when it comes to electronic blasting systems there are two basic techniques used for detonator programming. In the first, electronic detonators are programmed with individual firing times based on their location in the blasting pattern. This requires some deliberate action of an operator (blaster) taking into account the proposed blast design. This may involve keying in of a detonation delay time on a portable programming tool and relaying that delay time to the relevant detonator by some form of communication between the programming tool and the detonator (see, for example, U.S. Pat. No. 6,173,651). Alternatively, where the electronic detonator includes unique identity data associated with it, the identity of the detonator may be associated with a given blasthole into which the detonator is loaded, with individual detonator delay times then being allocated from a central control unit (blast box) using the identity data to address each detonator (see, for example, U.S. Pat. No. 5,894,103). In this case the identity data is invariably captured using a portable reader by visiting each blasthole. As a further alternative, an electronic detonator and the blasthole into which it is loaded may be indirectly associated by linking each with information as to their location. This generally involves an operator visiting each blasthole with a GPS device and logging the coordinates of each hole and the identity data of the detonator allocated to that blasthole. This information is subsequently downloaded and programming effected using a central control unit. These methods tend to be laborious and/or require the use of skilled operators and specialised equipment.

The second technique for programming electronic detonators relies on electrical connections to enable the relative position of detonators to be determined. For instance, systems exist in which a first detonator on a harness line is programmed with that detonator then communicating with the next detonator in order to enable the next detonator to be programmed, and so on. This so-called "daisy chain" programming arrangement does not require each detonator in a blasting arrangement to be visited by an operator but invariably requires an array of electrical connections to be made for the system to operate. Thus, US 2005/0016407 describes a blasting system in which detonators are connected to a programming and control line by four wires attached to (circuitry of) the detonator.

On the other hand, WO 2005/005915 describes a blasting system comprising a 2-wire communication bus line and a separate 2-wire daisy line extending from a control unit. Individual detonators are connected to the communication bus line by one pair of lead wires and to the daisy line by another pair of leads. The use of such systems requiring multiple connections to be made for each detonator can be time consuming and difficult to put into practice, especially in harsh mining environments. Furthermore, increasing the number of connector leads for a detonator increases vulnerability to damage. A number of detonator connector leads could be accommodated in high quality multi-core cables, but this is likely to add significantly to operating costs.

Against this background it would be desirable to provide an electronic blasting system that does not suffer the disadvantages described.

SUMMARY OF THE INVENTION

Accordingly, the present invention provides an electronic blasting system comprising:

a control unit;

a surface harness;

electronic detonators connected to the surface harness by a 2-wire lead, the detonators being adapted to provide information to the control unit in response to command signals transmitted by the control unit along the surface harness;

wherein the surface harness includes actuators that enable the control unit to communicate with individual detonators so that the arrangement of detonators can be determined by the control unit.

Herein the term "actuator" is used to denote an electronic component that is responsive to appropriate command signals transmitted by the control unit (along the surface harness) in order to enable the control unit to communicate with a detonator provided on the surface harness downstream of the actuator. In accordance with the present invention the control unit, actuators and detonators co-operate to allow the arrangement of detonators making up the blasting system to be determined by the control unit. In practice this determination is effected by selectively and sequentially accessing of the system by the control unit. This is achieved by transmission by the control unit of various command signals that result in some predetermined activity by individual actuators and detonators.

The surface harness will comprise a multi-wire lead for communication with the actuators and detonators making up the electronic blasting system of the invention. In one embodiment of the invention communications between the control unit and actuators takes place over wires that are independent of the wires that are used for communications between the control unit and the detonators. For example, the surface harness may be a 4-wire lead in which 2 wires are employed for communication between control unit and actuators and 2 (different) wires are used for communication between the control unit and detonators. Preferably, however, the surface harness line is a 2-wire lead to which the various actuators and detonators making up the blasting system are connected. This simplifies significantly implementation of the present invention. Unless otherwise stated, for the purposes of illustration it is to be assumed that a 2-wire lead is being used.

BRIEF DESCRIPTION OF THE DRAWINGS

Embodiments of the present invention are illustrated with reference to the accompanying non-limiting drawings in which.

DETAILED DESCRIPTION

Figure 1:
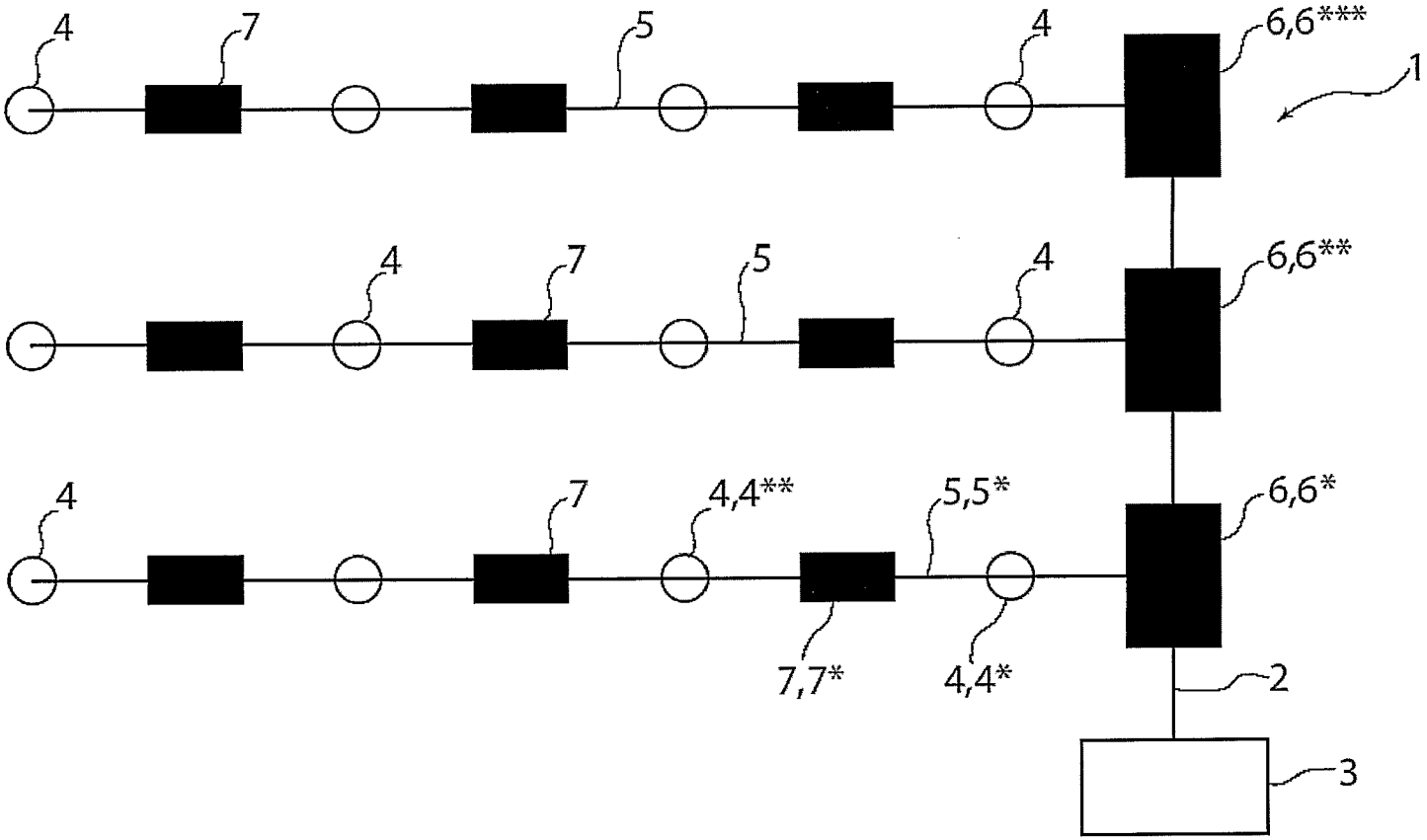
FIG. 1 is a schematic diagram illustrating a blasting system in accordance with the present invention.

The essential character of the invention may be illustrated by reference to an embodiment in which several rows of detonators are connected (by 2-wire leads) to a surface harness. In this case it is convenient to consider the surface harness as comprising a primary line with trunk lines connected to it. Each trunk line has connected to it individual detonators making up the same row. In a preferred embodiment of the invention, the surface harness, and thus the primary line and trunk lines, are 2-wire leads. As will be explained, for operation of the present invention it is necessary for each trunk line to be connected to the primary line by an actuator (termed hereafter for this embodiment as a "row actuator"), and for each trunk line to include an actuator between adjacent detonators (termed hereafter for this embodiment as a "gate").

In an embodiment of the invention multiple trunk lines are connected to the primary line by a single actuator with this actuator enabling each trunk line to be accessed sequentially by the control unit.

The row actuators through which each trunk line is connected to the primary line enable individual trunk lines, and thus individual rows of detonators, to be accessible to signals emanating from the control unit. Thus, the row actuator may be regarded as a node. Initially, each row actuator is in a closed or resting state with the effect that the control unit is not able to transmit command signals along a trunk line to components thereon. The operating state of each row actuator may however be changed by an appropriate command signal generated by the control unit. In response to this command signal the first row actuator encountered on the primary line changes operating state thereby allowing the corresponding trunk line to be accessible to signals subsequently transmitted by the control unit. Other trunk lines remain isolated with respect to command signals from the control unit due to the initial state of the corresponding row actuators being unchanged.

For a trunk line that is rendered accessible to command signals from the control unit, a first detonator on that line is available to communicate with the control unit in response to appropriate command signals. Thus, the control unit may interrogate the detonator in order to derive information from it. This information may be simple in character, such as the fact that the detonator is present, or more complex, as will be explained in more detail below. It will be appreciated from this that the detonator has the ability to receive signals from the control unit and to transmit signals conveying detonator information in return.

As noted, in the embodiment described, a gate is provided between adjacent detonators on respective trunk lines. The role of the gate is to isolate the next detonator provided further along the trunk line from the control unit until an appropriate command signal is transmitted to the gate. At that time the gate undergoes a change in operating state thereby allowing the next detonator along the trunk line to be interrogated by the control unit.

This approach is continued sequentially until each detonator on the same trunk line has been interrogated by the control unit. After this has been done the control unit recognises that the particular trunk line has been explored fully. This may happen by default when command signals transmitted along this trunk line go unanswered. At that point the control unit issues a command signal that will have the effect of changing the operating state of the next row actuator encountered on the primary line in order to access the next trunk line/row of detonators. This continues until each detonator in each row of detonators in the blasting system has been interrogated by the control unit. By selectively and sequentially accessing the blasting system, and by interrogation of individual detonators, the control unit is able to determine the arrangement of detonators and provide details thereof as required.

The characteristics of the row actuators and gates, in terms of operating sophistication, will vary depending upon the complexity of the blasting arrangement of detonators. What is meant by this may be illustrated with reference to the accompanying non-limiting figures.

FIG. 1 shows a blasting system (1) comprising a primary line (2) connected to a control unit (3). Running off the primary line (2) are three rows of electronic detonators (4) provided in respective blastholes. Each row contains four electronic detonators (4). Each detonator is provided on a trunk line (5) that is connected to the primary line (2) via a row actuator (6). Between each detonator (4) along a trunk harness line (5) is provided a gate (7). In the embodiment shown there are three gates (7) per trunk harness line (5).

In this embodiment the control unit (3) is connected at one end of the primary line (2). Initially, all of the row actuators (6) and gates (7) are configured such that the blasting system (1) is not accessible with respect to command signals generated by the control unit (3) and transmitted along the primary line (2). In practice of the invention the control unit (3) transmits an appropriate command signal that causes the first row actuator encountered (6*) to change state in order to allow command signals from the control unit to access the corresponding trunk line (5*). Subsequently, the first detonator (4*) provided on the trunk line (5*) is accessible to command signals from the control unit (3) transmitted along portions of the primary and trunk lines (2, 5*). On receipt of a suitable command signal this first detonator (5*) is able to report information to the control unit (3) where the information is logged. At this point in time the row actuator (6*) enables the control unit (3) to send command signals along only the first trunk harness line (5*) with other trunk lines (6, 6***) connected upstream to the primary line (2) being isolated and not accessible to the control unit (3**).

After relevant information associated with the first detonator (4*) has been logged by the control unit (3), the control unit (3) is prevented from interrogating the next detonator (4) along the trunk line (5*) by the presence of the gate (7*). In its initial state this gate prevents command signals being transmitted further along the trunk line (5*). However, in response to an appropriate command signal from the control unit (3), the gate (7*) undergoes a change in operating state thereby allowing the next detonator (4) along the trunk line (5*) to report to the control unit (3) in response to an appropriate command signal. Transmission of appropriate sequences of command signals in this way allows the control unit (3) to derive information about each detonator (4) provided on the first trunk line (5***).

When there are no further detonators (4) to be logged on the first trunk line (5*) the control unit (3) transmits a command signal that has the effect of changing the initial operating state (closed) of the next row actuator (6) encountered on the primary line (2). This row actuator (6**) then enables the corresponding trunk line (5**) to be accessible to command signals from the control unit (3). By transmission of appropriate command signals it is possible for each detonator (4) on this trunk line (5**) to be logged. The detonators on the remaining trunk line, i.e. the one most remote from the control unit (3**), may be logged in similar fashion.

The sequence of steps required to determine the arrangement of detonators would be along the lines:

1. Go to next row actuator
2. Log increment in row number
3. Switch row actuator "on"
4. Log increment in detonator (hole) number
5. Log new detonator
6. If there is gate further along the row, open gate and go to step 4
7. If there is no gate further along the row, go to step 1
8. If there is no new row actuator, end In this embodiment the row actuators and the command signals transmitted by the control unit may be relatively simple in order to achieve the desired outcome because there is only one trunk line associated with each row actuator. With more complex arrangements more sophisticated row actuators may be called for and the command signals may need to be more detailed and specific in content. What is meant by this may be understood with reference to FIGS. 2*a* and 2*b* which illustrate another embodiment of the present invention.

Figure 2A:
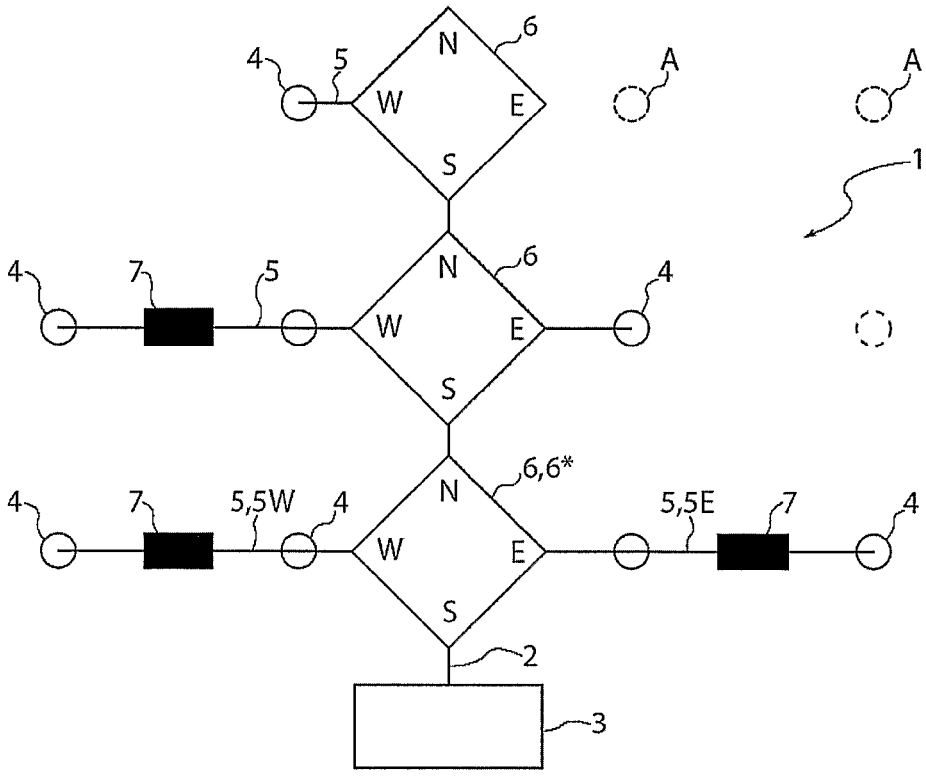
FIG. 2*a* is a schematic diagram illustrating another blasting system in accordance with the present invention.
Figure 2B:
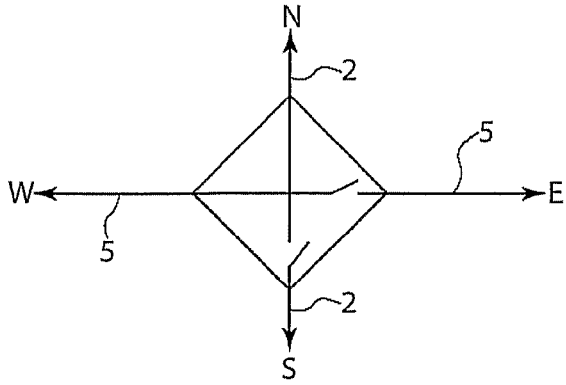
FIG. 2*b* represents an actuator used in the blasting system illustrated in FIG. 2*a;*

Using similar nomenclature as used in FIG. 1, FIG. 2*a* shows a blasting system (1) comprising a primary line (2) connected to a control unit (3). Running off the primary line (2) are three rows of electronic detonators (4) provided in respective blastholes. In this case however there are a total of five trunk lines (5) defining only three rows of detonators (4). Three of the trunk lines include two detonators. The remaining two trunk harness lines include a single detonator (4) only. Blastholes A are missing from an otherwise geometrically regular pattern. Each trunk line (5) is connected to the primary line (2) via a row actuator (6). In this case the row actuator (6) is configured to enable the two trunk lines to be accessed sequentially by the control unit (3). The general configuration of the row actuator (6) is illustrated in more detail in FIG. 2*b*. Here, by way of example, the row actuator (6) is shown as including two switches that will enable the arrangement of detonators to be determined by sequential transmission of command signals from the control unit. Compass directions are included in the figure for ease of reference. In the embodiment shown the row actuators (6) used are of the same design with the relative orientation of them being important to satisfactory operation. Gates (7) are provided between detonators (4) on the same trunk line (5).

Initially, both switches in each row actuator (6) are in the open position. On receipt of a suitable command signal from the control unit (3) the "south" switch of the first row actuator (6*) encountered on the primary line (2) closes, thereby enabling the control unit (3) to transmit command signals to components provided on the trunk line extending in the westerly direction (5W). Subsequently, command signals can then be applied to log the detonators (4) on this limb of the system with suitable activation of the intervening gate (7) as required. When these detonators (4) have been logged, a command signal is transmitted in order to close the "east" switch of the row actuator (6*) thereby allowing the trunk line extending in the easterly direction (SE) to be accessed. When this has been completed an appropriate command signal closes the "south" switch on the next row actuator (6) along the primary line (2). Detonators (4) present on the trunk lines (5) running from this row actuator (6****) can then be logged in the manner described. This process is repeated until each detonator in each row of detonators has been logged by the control unit.

The actuator can be any type of electronic device that fulfils the requisite function as described in response to an appropriate command signal transmitted by the control unit. The type of actuator used for a given blasting system will be selected such that each and every detonator in the system may be accessed and logged in accordance with the invention. The type of actuator used will depend upon its position in the surface harness. Thus, where the actuator is provided at a junction point, for instance where one or more trunk lines branch from a primary line, the actuator must be adapted to allow each limb of the system extending from it to be accessed by the control unit. In this case the actuator will include one input line for receiving command signals form the control unit and at least two output lines, the actuator being adapted to allow sequential access to each output line. This arrangement is illustrated in FIG. 1 by the row actuators (6, 6***). In this embodiment the actuators take on a Y-configuration. It will be appreciated however that other configurations are possible, such as a T- of X-configuration. The latter is illustrated in FIGS. 2***a* and 2*b* where the actuator (6) is provided in the form of a compass switch.

On the other hand, a relatively simple actuator configuration may be used when the actuator serves as a controllable gate between two components. This arrangement is shown in FIG. 1 where the actuators/gates (7) are provided on a trunk line between adjacent detonators. Here the actuators function as linear control points with a single input line and a single output line.

Preferably, at least one, or each, actuator has the ability to communicate to the control unit its existing operating state and/or whether a change in operating state has been successfully effected. The actuator may exhibit other functionality, such as the ability to perform diagnostics on local wiring and detonators, and to report the results thereof to the control unit. The actuator may also perform signal amplification to ensure that command signals emanating from the control unit (and passing through the actuator) have sufficient strength and integrity to be acted upon across the entire blasting system. This may be especially useful in extensive blasting systems.

A primary requirement of the actuator is that it may be controlled by application of command signals across the harness to which the actuator is connected. In one embodiment the state of the actuator may be changed in a reversible fashion in response to appropriate command signals.

In selecting a suitable actuator for use in the present invention it is necessary to consider its electrical resistance and thus the voltage drop that will be associated with the actuator during its use. This is because the voltage drop attributable to the actuators over the blasting system will be cumulative. If the voltage drop is too high, there is low energy transfer and communication problems can arise. The voltage drop associated with a particular type of actuator may influence the extent and complexity of the blasting system in which the actuator may be used. For example, where the blasting system includes a large number of detonators, it will also be necessary to use a large number of actuators to enable the present invention to be put into effect. In this case, to avoid excessive voltage drop across the system, it will be necessary to employ actuators with individually low voltage drop. In contrast, for relatively simple arrangements of detonators requiring fewer actuators, such as may be the case in a quarry shot. It may be possible to use actuators that have a relatively higher voltage drop associated with their use. One skilled in the art would be aware of, or be able to determine the maximum voltage drop that may be tolerated in a given practical situation and to select appropriate actuators accordingly.

It is also important that each actuator used in accordance with the invention is able to handle the kind of current levels that will be required for the control unit to communicate with detonators and downstream actuators across the entire blasting system. However, current consumption should be kept within reasonable limits since high currents will also lend to high voltage drops over the network of components making up the blasting system. This may be especially critical where the control unit is battery-powered. Again, one skilled in the art would be familiar with the kind of operating currents that would be used in practice.

It may also be important for individual actuators to include some form of protection against static discharge since the componentry making up the blasting system is likely to be employed in situations where generation of static electricity may be prevalent. One skilled in the art will be familiar with methods of making electronic components, such as the actuators, statically immune.

A further consideration in selecting an actuator may be cost. In practice, this is likely to be an important consideration given that a significant number of actuators may need to be employed in a blasting system.

It will be appreciated from the foregoing that a number of factors will usually need to be considered when selecting the type of actuator for use in the present invention. This selection will involve a consideration of the size and complexity of the blasting system, and of the proposed operating characteristics of the system. All things being equal, cost may ultimately dictate the type of actuator that is used.

The complexity required of the actuator will vary depending upon the context in which it is used, as will be apparent from the preceding discussion. In its simplest form the actuator may be a switch, such as a relay-operated switch, that is adapted to operate (close) the switch in response to an appropriate command signal received from the control unit. If the actuator is provided at the junction of a primary line and two trunk lines, as depicted in parts of the blasting system shown in FIG. 2*b*, multiple switches may be present in a single actuator and these individual switches must be adapted to allow selective control by the control module.

Any electronic component satisfying the various operating requirements described herein may be used as an actuator in practice of the present invention. Typically, the electronic component will comprise a switch. Each switch may be a discrete device. Alternatively, in more sophisticated embodiments of the invention, the switch may be integrated in an application specific integrated circuit (ASIC). Devices useful as actuators in the present invention are known in the art or may be constructed from conventional components taking into account the required functionality.

The actuator may comprise a mechanical-type switch such as a mechanical relay, or an electronic-type switch. Taking into account the various issues described in relation to actuator selection, specific examples of actuators that may be useful in practice of the present invention include relays (such as reed relays, latching relays, bipolar relays and solid state relays), transistor switches (such as BJT transistor switches, Darlington transistor switches and field effect transistor (FET) switches), analog switches, photocouplers, IGBT switches and SCR switches. The use of certain types of these actuator may be restricted to relatively simple networks of limited numbers of detonators due to the inherent operating characteristics of the actuator. Thus, when using Darlington transistor switches, after a few switches in series, the total voltage drop becomes impractical for large scale blasting systems. Bipolar relays on the other hand are free of any voltage drop once switched. Such relays require an impulse (eg cap discharge) to switch on and a reverse impulse to switch off. Without control energy they remain in the set position. Furthermore, biopolar relays do not require much by way of protection against electrostatic discharge.

Analog switches are ideal in low-distortion applications and are generally preferred to mechanical switches where current switching is required. Analog switches tend to have low power requirements and good reliability. Useful analog switches include commercially available quad analog switches, for example available from Maxim Integrated Products. Examples of commercially available products include the MAX 4601, MAX 4602 and MAX 4603 quad analog switches. Analog switches having similar and suitable operating characteristics are commercially available from other sources.

Figure 7:
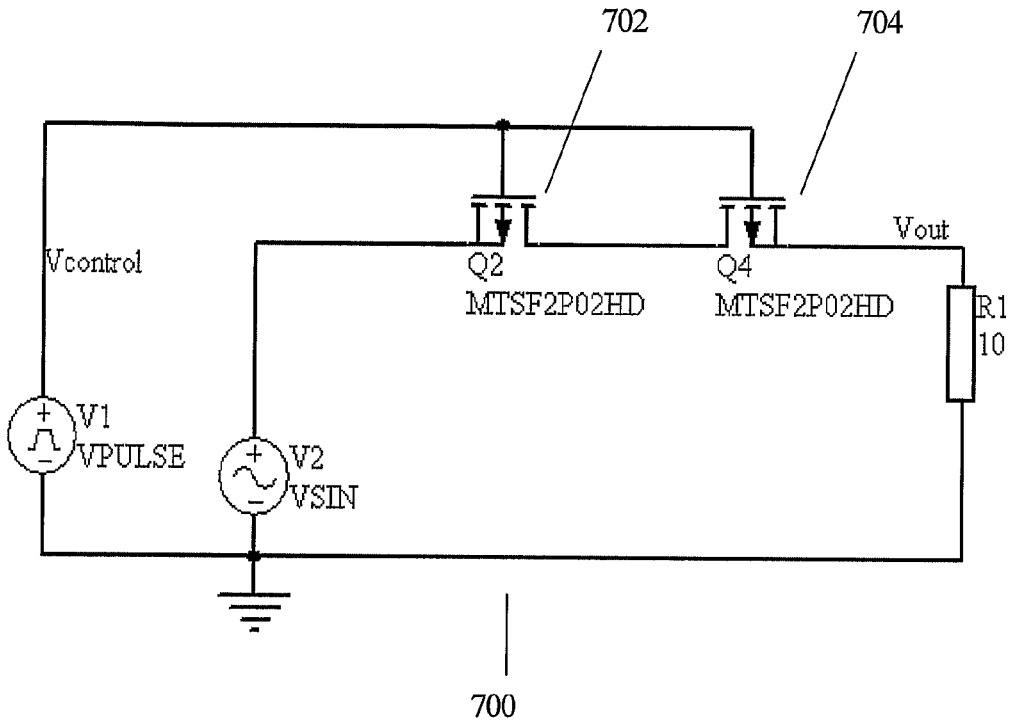
FIG. 7 is a schematic diagram of a switching circuit for use in actuators of the present invention.

In a preferred embodiment, the switches used in the actuators are implemented as field effect transistors (FETs). FIG. 7 illustrates an example switching circuit 700 that includes FETs 702 and 704. In the embodiment shown, V1 is a ±13V 1 kHz square wave generator. V2 is a 12V bipolar sine wave generator. The voltage drop across the FETs is slightly dependent upon the current applied. For this high load it is about 0.5V and for a 100 ohm load it is about 0.1V.

FET switches have characteristics that make them especially suitable for use in the present invention. The required control current is virtually zero after the initial switching current and the FET switch has very low "on" resistance resulting in suitably low voltage drop. FET switches are however sensitive to static and would therefore require static protection circuitry.

The type of actuator used between adjacent detonators may depend upon the characteristics of the actuator that is used to control access of command signals to individual trunk lines. For example, in the embodiment shown in FIGS. 2*a* and 2*b* each row actuator is configured to enable individual trunk lines to be selectively accessed. In this case the gate provided on each trunk line making up a single row may be the same and thus responsive to the same kind of command signal, since the row actuator allows distinction between which trunk line is being accessed at any given time. However, the same result could be achieved by using a simplified design for the row actuator in which only the "southern" input is operative in response to an appropriate command signal. In this case, however, when this input is activated and there are two trunk lines connected via the row actuator, both trunk lines are potentially accessible by the control unit. To allow individual trunk lines to be activated use may be made of gates in each line that are responsive to different operating commands, i.e. addressable gates are used that respond to a gate-specific command signal. In this way it is possible for the control unit to explore one trunk line before the other. In this case however it may be useful to include a suitable gate before the first detonator provided on each trunk line to avoid any confusion as to which detonator is being accessed first.

Depending upon the design of the blasting system, and in particular on the sophistication of the actuators used, it may be necessary to connect the control unit at a particular location on the surface harness. For example, in the embodiment shown in FIG. 1, where relatively simple row actuators and gates are employed, it is important to connect the control unit to the primary line upstream of the first row actuator in order for complete determination of the detonator arrangement. In other, more sophisticated embodiments of the invention, it may be possible for the control unit to determine fully the arrangement of detonators irrespective of where the control unit is connected to the surface harness. For this capability, the blasting system should be designed accordingly with selection and use of appropriate actuators.

In another embodiment of the invention an actuator is associated with a component of the blasting system and information relating to this association is stored in the actuator and accessible by the control unit. This embodiment is illustrated in general terms in FIG. 3.

Figure 3:
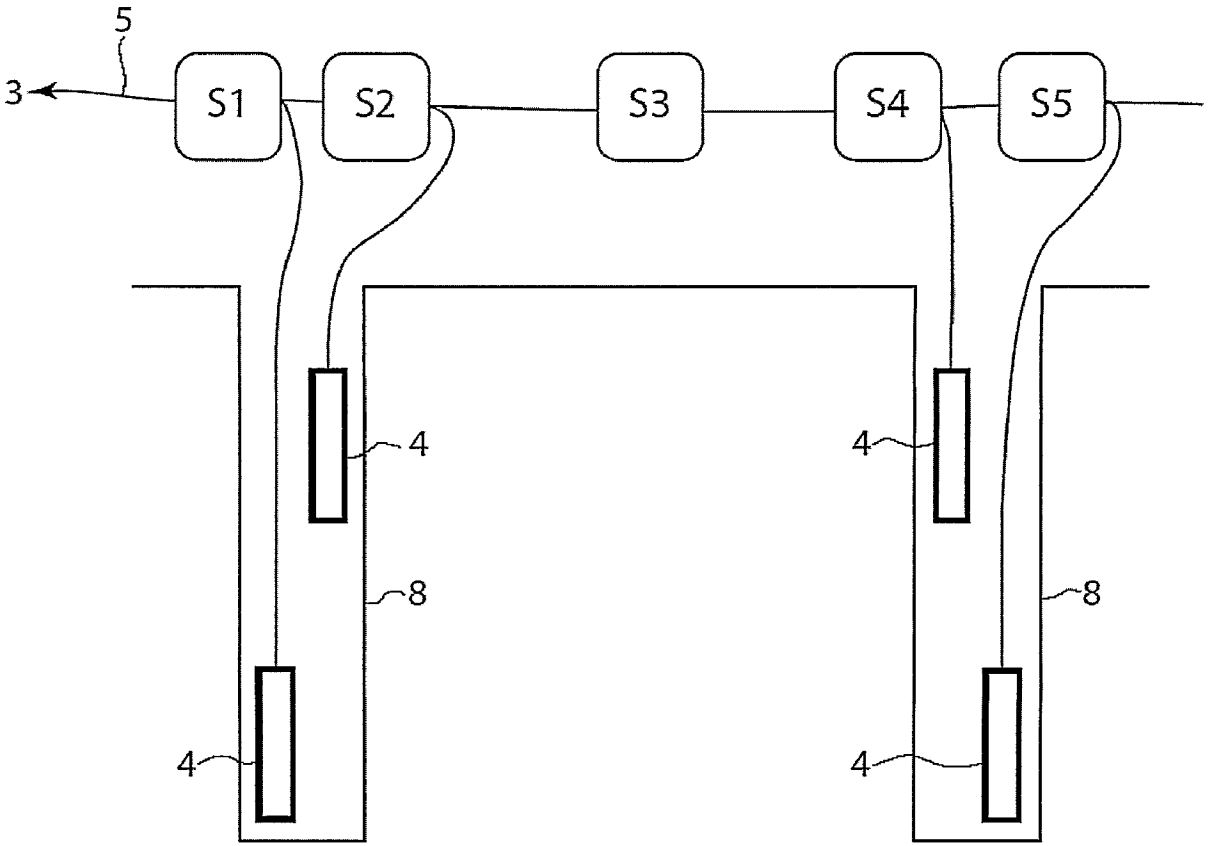
FIG. 3 is a schematic diagram illustrating an aspect of a blasting system in accordance with the present invention.

FIG. 3 shows a number of detonators (4) provided in blastholes (8) extending along a row. Each detonator (4) is connected to a trunk line (5) which itself is connected at one end to a primary line via a row actuator (not shown). In turn the primary line is connected to a control unit (also not shown but in the direction denoted 3). Each detonator has associated with it an actuator (S1, S2, S4 and S5). As well as fulfilling the function described above in response to appropriate command signals from the control unit, each of these actuators includes some information relating to the detonator with which it is associated. Thus, S1 includes information reflecting that it is attached to a relatively long length of downline that allows a detonator to be placed at or towards the bottom of the blasthole. In contrast S2 includes information that reflects that it is associated with a relatively short length of downline that is attached to a detonator to be placed at or towards the top of the blasthole. Similarly, S4 and S5 include information relative to the detonators with which they are associated. When these actuators (S1, S2, S4 and S5) are accessed by the control unit, in addition to controlling access of the control unit to the associated detonator, the actuators are also adapted to communicate relevant information about the associated detonator.

In the (non-limiting) embodiment shown in FIG. 3 there is included a further actuator S3. This gate is not associated directly with a detonator but may, for example, be associated with a length of connecting line (extending between actuators S2 and S4) and include information to this effect that may be accessible to the control unit. It will be appreciated that the approach adopted in this embodiment will allow a comprehensive picture of the blasting system to be ascertained by suitable interrogation by the control unit.

The electronic detonators used in practice of the invention can be any of a variety of conventional designs. As a minimum, the detonator must possess a counter and a stored delay time so that energy will be delivered to the pyrotechnic/explosive train of the detonator after counting down the delay time after receiving a "commit-to-fire" command. As a further and desirable sophistication, the detonators may have the ability to communicate information as required back to a control unit in response to suitable interrogatory command signals. The detonator may have memory functionality in order to store identification data specific to the detonator. This data may be allocated and stored by the detonator prior to use, for example on manufacture, or programmed into the detonator during the process of detonator determination as described herein. The identity data associated with a detonator may be used to allow individual detonators to be addressed by the control unit thereby facilitating detonator delay time programming. In this case, no two detonators in the blasting system will have the same identity. The detonator may advantageously include a means of calibrating the counter to ensure accuracy even when detonators may be in different temperature environments. The detonator may for safety reasons communicate at a voltage too low to initiate the pyrotechnics/explosives train i.e. when communicating the detonator is inherently safe. Actuators associated with such detonators will have to be able to operate at two or more voltages. Examples of commercially available electronic detonators suitable for use in the present invention include UniTronic™ and i-Kon™, both available from Orica.

Each detonator is connected to the surface harness line by a 2-wire lead. This enables the detonator to be connected to the harness with relative ease and avoids the problems encountered with the kind of multiple wire systems mentioned earlier. Conventional means of connecting the 2-wire lead to the harness may be employed. The 2-wire lead used to connect each detonator to the harness includes 2 conductor wires, one an earth wire and the other a power/communications wire. The power/communications wire is discontinuous, being broken at an actuator provided upstream of any given detonator. Suitable activation of the control unit by an appropriate command signal from the control unit results in circuit completion involving the power/communication line thereby allowing the detonator to be accessed by the control unit. The surface harness itself may contain 2 or more conductors surrounded by a suitable sheath.

Figure 4:
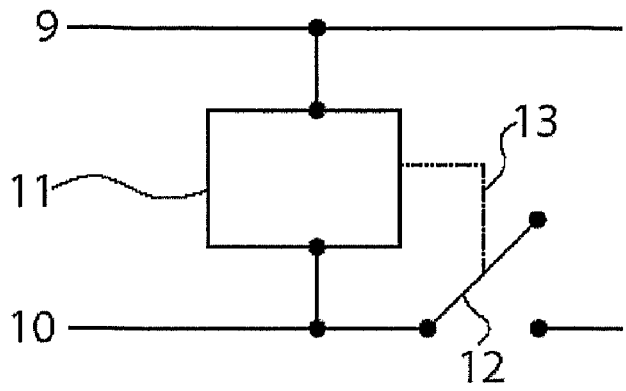
FIGS. 4-6 illustrate components for use in embodiments of the present invention.
Figure 5:
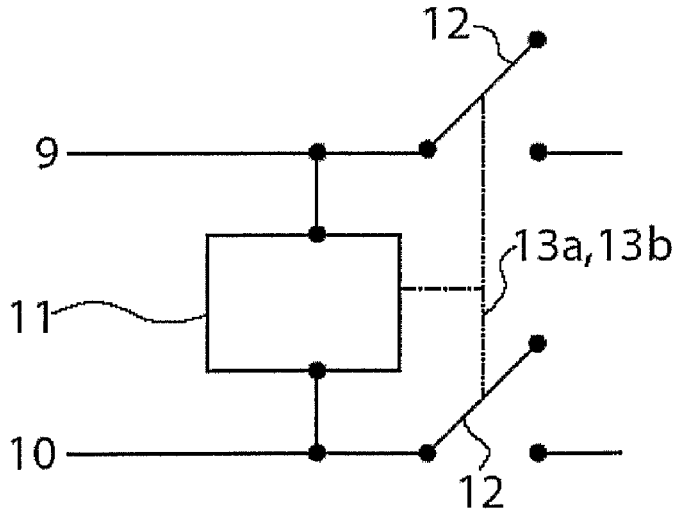
Figure 6:
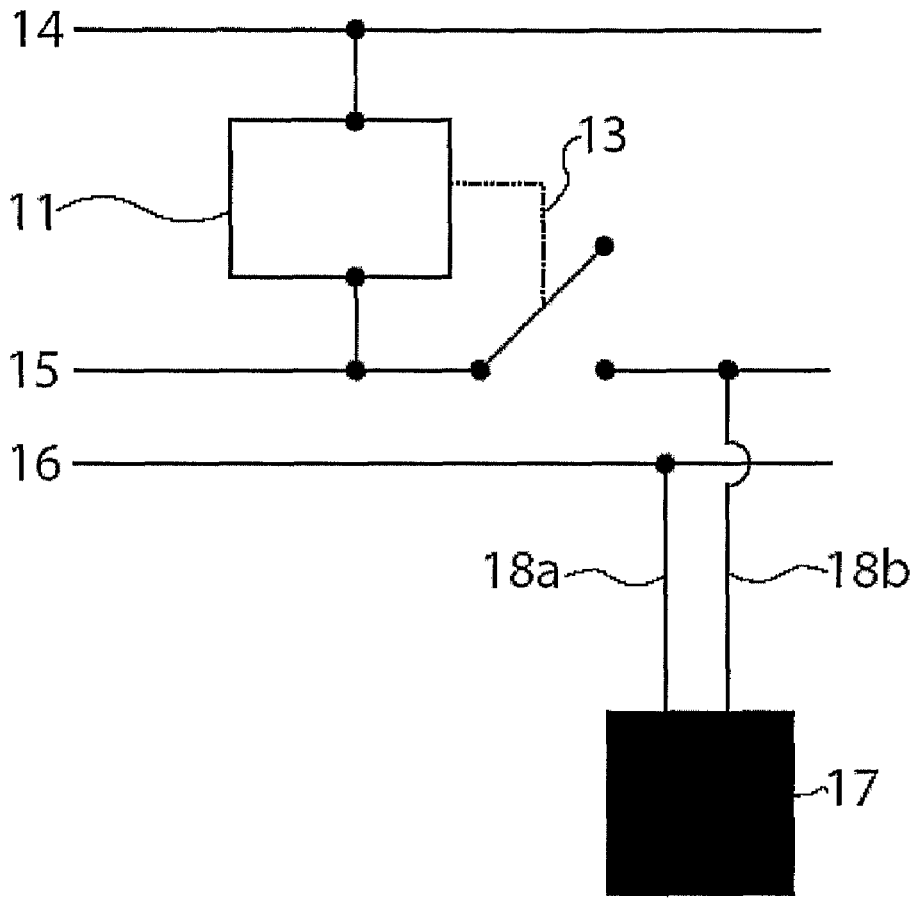

Examples of actuators useful in practice of the invention for controlling access of a control unit are shown in FIGS. 4, 5 and 6. FIG. 4 shows a harness consisting of 2 lines (9, 10) between which is connected an actuator (11). The actuator will include componentry that enables it to be responsive to appropriate command signals received from a control unit (not shown) along the harness lines (9, 10). The actuator (11) also includes a switch (12) that may be closed by action of a switching mechanism (13) of the actuator (11). The arrangement shown is so-called 2-wire 1-switch configuration.

FIG. 5 shows a variation in which the actuator (11) includes two switches (12*a*, 12*b*) with associated switching mechanisms (13*a*, 13*b*), i.e. a 2-wire 2-switch configuration.

FIG. 6 shows a further variation in which the harness consists of 3 lines (14, 15, 16). A detonator (17) is connected to 2 of these lines (15,16) by a 2-wire lead (18*a*, 18*b*). An actuator (11) is provided between a different pair of lines (14, 15) and includes a switch (12) that when closed will allow communication with the detonator (17) along lines 15, 16. This arrangement is a so-called 3-wire 1-switch configuration.

It will be appreciated that an advantage of the blasting system of the present invention is that it may be implemented with ease using relatively simple componentry. Such componentry is likely to be readily available, and this may also have beneficial cost implications.

The present invention also extends to a method of blasting in which a blasting system in accordance with the invention is implemented in order to allow the arrangement of detonators to be determined. In one embodiment the method further comprises programming of individual detonators with delay times based on the arrangement of detonators so-determined. In this embodiment determination of the actual arrangement of detonators is fundamental to appropriate programming of the detonators. A significant advantage associated with this aspect of the invention is that the determination of detonators and the programming thereof can be undertaken remotely by the control unit. Thus, it is not necessary for a blaster to visit individual detonators in the blast field in order to carry out logging of detonator (identity and position) in order to facilitate detonator programming.

The time delay allocated to any given detonator will vary depending upon its position in the intended sequence of firing. The detonators may be programmed selectively and sequentially by applying the same methodology described herein for determining the arrangement of detonators. In this case the actuators must be re-set prior to programming. Alternatively, where individual detonators have identity data, these data may be used to facilitate programming. In this case, once the operating state of each actuator has been changed, in order to effect characterisation of the blasting system, no further changes in actuator operating state are called for.

As noted, depending upon the complexity of the blasting system, it may be necessary in order to implement the present invention to use actuators that are addressable. The use of addressable actuators may also facilitate programming of individual detonators by the control unit, or enable the control unit to perform diagnostic tests on any given actuator and/or detonator in the blasting system of the present invention. The number of addressable actuators may vary as required. For instance, in the embodiment discussed above in relation to FIGS. 2*a* and 2*b* where each row actuator used has only a "southern" input, to allow distinction between trunk lines extending from each actuator addressable gates are used. In this embodiment two different addresses will be sufficient to allow distinction between trunk lines. In other arrangements more than two addressable actuators may be required.

In another embodiment, the present invention provides a method of blasting which comprises installing a blasting system in accordance with the present invention, the detonators being arranged according to a predetermined detonator pattern, determining the actual arrangement of detonators operatively connected to the surface harness and comparing the actual arrangement of detonators with the predetermined detonator pattern in order to identify possible discrepancies between the two. In this embodiment, the expression "operatively connected" is intended to mean that a detonator is connected to the surface harness in such a way that the detonator is capable of receiving commands from the control unit and responding thereto as might be required during use of the detonator in practice. Thus, by comparing the actual arrangement of potentially active detonators as determined by the control unit with the planned arrangement of detonators according to the predetermined (intended) detonator pattern, it is possible to identify any variations between the actual arrangement and the arrangement as planned.

This embodiment of the invention may be applied to identify connection faults and, more importantly, the location of such connection faults in the context of the overall planned arrangement of detonators. If faults are encountered, it may be necessary for the blaster to re-enter the area of the blast to correct faults. Such faults may include errors in the detonator connection sequence, detonators not connected to the wiring harness, wires damaged due to the harsh environment of mining and/or by people or equipment, etc. Once any faults have been located and repaired, the control unit will need to execute its programming sequence again. For this, all actuators will have to be returned to their original state in response to appropriate command signal(s) from the control unit. This reversibility in the state of the actuators is a preferred aspect of the invention.

This embodiment of the invention may also include the additional step of programming individual detonators with a time delay. The time delay allocated to individual detonators may be derived from the predetermined pattern established for the detonators. That pattern will invariably also include information as to individual detonator timing.

By virtue of activating the actuators in the surface harness in sequence, with parallel discovery of the identity and relative location of detonators, the control unit discovers which detonators are where. The control unit can then proceed with the remainder of its function, namely to assign firing times to every detonator. These firing times may be derived from a blast plan stored in the memory of the control unit, or they may be entered via a keypad one by one by the blaster, or they may be entered as a an inter-hole delay between detonators on the trunk lines and inter-row delays between the sets of detonators on successively-firing trunk lines. The control unit may have other interfaces for the blaster in the form, perhaps, of menu options, in which the blaster may select delays that change in a desired pattern from one end of the row to the other.

The control unit used in practice of the present invention invariably operates under the control of a microprocessor in order to perform as required. The control unit includes means for transmitting command signals along a surface harness to which it is connected and means for receiving a variety of information returned along the harness. The control unit also includes means for acting on information received in order to determine the arrangement of detonators in the blasting system and for providing information about that arrangement. Invariably, the control unit used for determining the arrangement of detonators will also be used for controlling detonator function. Thus, the control unit will typically be adapted to perform diagnostic tests on the detonators and program the detonators with delay times. One skilled in the art would be familiar with the type of components that will be required in the control unit to achieve the required functionality.

In a preferred embodiment, and contingent upon various embodiments of the present invention described herein, the control unit performs a multitude of functions, namely: to identify and record the type, number and sequence of actuators it encounters; to successively activate the actuators to expose one at a time new detonators; to determine the condition of the downline to the detonator, specifically by measuring leakage current between the 2-wires of the downline; to assign an identity code to each new detonator, or to assign a firing time to the detonator, or to record the unique identity code already stored in the detonator; to associate the detonator's code with its relative position; to calibrate the counters of the detonators; to assign firing times to the detonators; to interface with a stored blast design; to interface with the blaster (or shot-firer); to report on errors; to abort the blast under pre-programmed conditions; to communicate progress in programming the system to the blaster; to send the "fire" command (or "begin counting" or "commit-to-fire" command) to all detonators; and to export the details of the blast on request. The communication between the control unit and the detonators, data storage systems and the blaster may be digital, analogue, visible (graphical user interface) and/or audible. The above functions of the blast control unit may be performed by a single piece of equipment or may be performed by two or more pieces of equipment.

The invention claimed is:

1. An electronic blasting system comprising:

a control unit;

a surface harness; and electronic detonators connected to the surface harness by a 2-wire lead, the detonators being adapted to provide information to the control unit in response to command signals transmitted by the control unit along the surface harness;

wherein the surface harness includes actuators that enable the control unit to communicate with individual unknown detonators so that the arrangement of detonators can be determined by the control unit, and wherein communication between the control unit and individual detonators can be bi-directional.

2. An electronic blasting system according to claim 1, wherein the surface harness comprises a primary line with trunk lines connected to it, wherein each trunk line has connected to it individual detonators making up the same row, wherein each trunk line is connected to the primary line by an actuator, and wherein each trunk line includes an actuator between adjacent detonators.

3. An electronic blasting system according to claim 2, wherein multiple trunk lines are connected to the primary line by a single actuator with this actuator enabling each trunk line to be accessed sequentially by the control unit.

4. An electronic blasting system according to claim 1, wherein at least one actuator has the ability to communicate to the control unit its existing operating state and/or whether a change in operating state has been successfully effected.

5. An electronic blasting system according to claim 1, wherein each actuator has the ability to communicate to the control unit its existing operating state and/or whether a change in operating state has been successfully effected.

6. An electronic blasting system according to claim 1, wherein at least one actuator has the ability to perform diagnostics on local wiring and detonators, and to report the results thereof to the control unit.

7. An electronic blasting system according to claim 1, wherein at least one actuator is able to perform signal amplification to ensure that command signals emanating from the control unit have sufficient strength and integrity to be acted upon across the entire blasting system.

8. An electronic blasting system according to claim 1, wherein the state of each actuator may be changed in a reversible fashion in response to appropriate command signals.

9. An electronic blasting system according to claim 1, wherein each actuator comprises a switch.

10. An electronic blasting system according to claim 9, wherein the switch is integrated in an application specific integrated circuit (ASIC).

11. An electronic blasting system according to claim 9, wherein the switch is implemented as a field effect transistor.

12. An electronic blasting system according to claim 1, wherein an actuator is associated with a component of the blasting system and information relating to this association is stored in the actuator and accessible by the control unit.

13. An electronic blasting system according to claim 12, wherein the actuator includes information relating to a detonator with which it is associated.

14. An electronic blasting system of claim 1, wherein the surface harness is a 2-wire lead.

15. A method of blasting in which an electronic blasting system as claimed in claim 1 is implemented in order to allow an arrangement of detonators to be determined.

16. A method according to claim 14 further comprising programming of individual detonators with delay times based on the arrangement of detonators so-determined.

17. A method according to claim 16, wherein determination of the arrangement of detonators and programming of the detonators is undertaken remotely by a control unit.

18. A method of blasting which comprises installing an electronic blasting system as claimed in claim 1.

19. A method according to claim 18, further comprising the step of programming individual detonators with a time delay.

* * * * *